US006199853B1

(12) United States Patent
Andoh et al.

(10) Patent No.: US 6,199,853 B1
(45) **Date of Patent: *Mar. 13, 2001**

(54) DOCUMENT HANDLER WITH A STAPLE MODE AND A MOVEABLE STOPPER

(75) Inventors: Akihito Andoh, Kawasaki; Shinji Asami, Saitama-ken; Kenji Yamada, Tokyo-to; Hiroki Okada, Yokohama; Masahiro Tamura, Yokohama; Masahiro Minato, Yokohama, all of (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/854,020

(22) Filed: May 8, 1997

(30) Foreign Application Priority Data

May 8, 1996 (JP) ..... 8-113709

(51) Int. Cl.[7] ..... B65H 39/10

(52) U.S. Cl. ..... 270/58.14; 270/58.08; 270/58.12; 270/58.13; 271/207

(58) Field of Search ..... 399/410; 270/58.07, 270/58.08, 58.12, 58.13, 58.14, 37; 271/207

(56) References Cited

U.S. PATENT DOCUMENTS 4,925,172 * 5/1990 Christy et al. ..... 270/58.12
5,020,784 * 6/1991 Asami et al. ..... 270/58.11
5,037,077 * 8/1991 Kubota et al. ..... 270/58.12
5,320,336 * 6/1994 Asami ..... 270/58.08
5,382,011 * 1/1995 Tani ..... 270/37
5,442,432 * 8/1995 Tani ..... 399/410
5,478,062 * 12/1995 Horiuchi et al. ..... 270/53
5,508,798 * 4/1996 Yamada ..... 270/58.09
5,709,376 * 1/1998 Ushirogata ..... 270/58.11

FOREIGN PATENT DOCUMENTS 5-590 1/1993 (JP) .

* cited by examiner

*Primary Examiner*—Christopher P. Ellis
*Assistant Examiner*—Patrick Mackey
(74) *Attorney, Agent, or Firm*—Oblon, Spivak, McClelland, Maier & Neustadt, P.C.

(57) ABSTRACT

An automatic document feeder which is operable in each of a sort/stack mode, an inversion mode, and a staple mode. A tray is provided on which a document to be stapled is stacked. A positioning element and a driving roller are provided for directing the document to be stapled to the tray and for properly positioning the document on the tray. A movable stopper is formed on the tray for properly positioning the document at a stacking position, a stapling position, and a discharge position. The document can be stapled at either a single place or at multiple places. The document passes through a first document path in the sort/staple mode, and passes through a second document path in a staple mode. The document also passes through a portion of the second document path in the inversion mode.

20 Claims, 10 Drawing Sheets

DOCUMENT HANDLER WITH A STAPLE MODE AND A MOVEABLE STOPPER

BACKGROUND OF THE INVENTION

1. Field of the Invention

The present invention is directed to a document handler which includes a staple mode.

2. Discussion of the Background

Document handler systems which include a staple mode are known in which sheets of a document can be stapled together prior to being discharged from an image forming apparatus. One example of such a document handler system is disclosed in Japanese Laid Open Patent Application No. 5-590.

FIG. 1 of this Japanese document 5-590 is reprinted here as FIG. 10. As shown in FIG. 10, the document handler of this Japanese document 5-590 includes a stapler unit 3 attached to a main body 1 of a copying machine as an image forming apparatus. In this device, a copy sheet is formed in the main body 1, and is ejected through an outlet of the main body 1 and is fed by rollers 901 in the stapler unit 3. In the staple mode, a copy sheet is fed by the rollers 901 to a finishing tray 400 and is further fed by the brush roller 101 towards an end fence 102 on the finishing tray 100. With this operation, a leading edge of the copy sheet is aligned on the end fence 102. Side fences (not shown) are also disposed on the finishing tray 400 for properly aligning the copy sheet on the finishing tray 400 transversely. Such an alignment is sequentially executed to successive copy sheets, and thereby a stack of copy sheets are positioned on the finishing tray 400. Then, the stack of copy sheets is stapled by the stapler 302 which is fixedly disposed on the finishing tray 400. Then, the stapled stack of copy sheets is moved transversely by one of the side fences, and thereby the stapled stack of copy sheets is ejected from the finishing tray 400.

Such a stapler unit 3 as disclosed in FIG. 10 suffers from drawbacks in requiring a complicated structure to position and eject the stapled sheets. Further, such a stapler unit 3 as shown in FIG. 10 does not lend itself to a multiple stapling operation.

SUMMARY OF THE INVENTION

Accordingly, one object of the present invention is to provide a novel document handler which overcomes the drawbacks in the background art.

A more specific object of the present invention is to provide a novel document handler, which is operable in a staple mode, and which can ensure that documents to be stapled are properly positioned on a stapler stacking tray. The present invention achieves such an object by providing a specialized brush or positioning structure to ensure that edges of a document to be stapled are properly positioned.

A further object of the present invention is to provide a novel document handler with a movable stopper at a stapler stacking tray which can ensure that the documents to be stapled are properly positioned in a stapling position and are thereafter properly discharged.

A further object of the present invention is to provide a novel document handler operable in a staple mode and in which a multiple place staple operation for stapling a document in multiple places can be easily effectuated. The present invention achieves such an object by either providing a stapler which is movable to multiple places, or by providing a stationary stapler and a movable stopper for moving a document to be stapled to the multiple places.

A further object of the present invention is to provide a novel document handler which has a compact design such that operations in a sort/stack mode, an inversion mode and a staple mode can be easily effectuated. The present invention achieves such an object by providing a document feeder with a first path through which a document passes in a sort/stack mode and a second document path through which a document passes in a stapled mode. Further, in the present invention in an inversion mode a document passes through a portion of the second document path.

BRIEF DESCRIPTION OF THE DRAWINGS

A more complete appreciation of the present invention, and many of the attendant advantages thereof will be readily obtained as the present invention becomes better understood by reference to the following description when considered in connection with the accompanying drawings, wherein.

DESCRIPTION OF THE PREFERRED EMBODIMENTS

Figure 1:
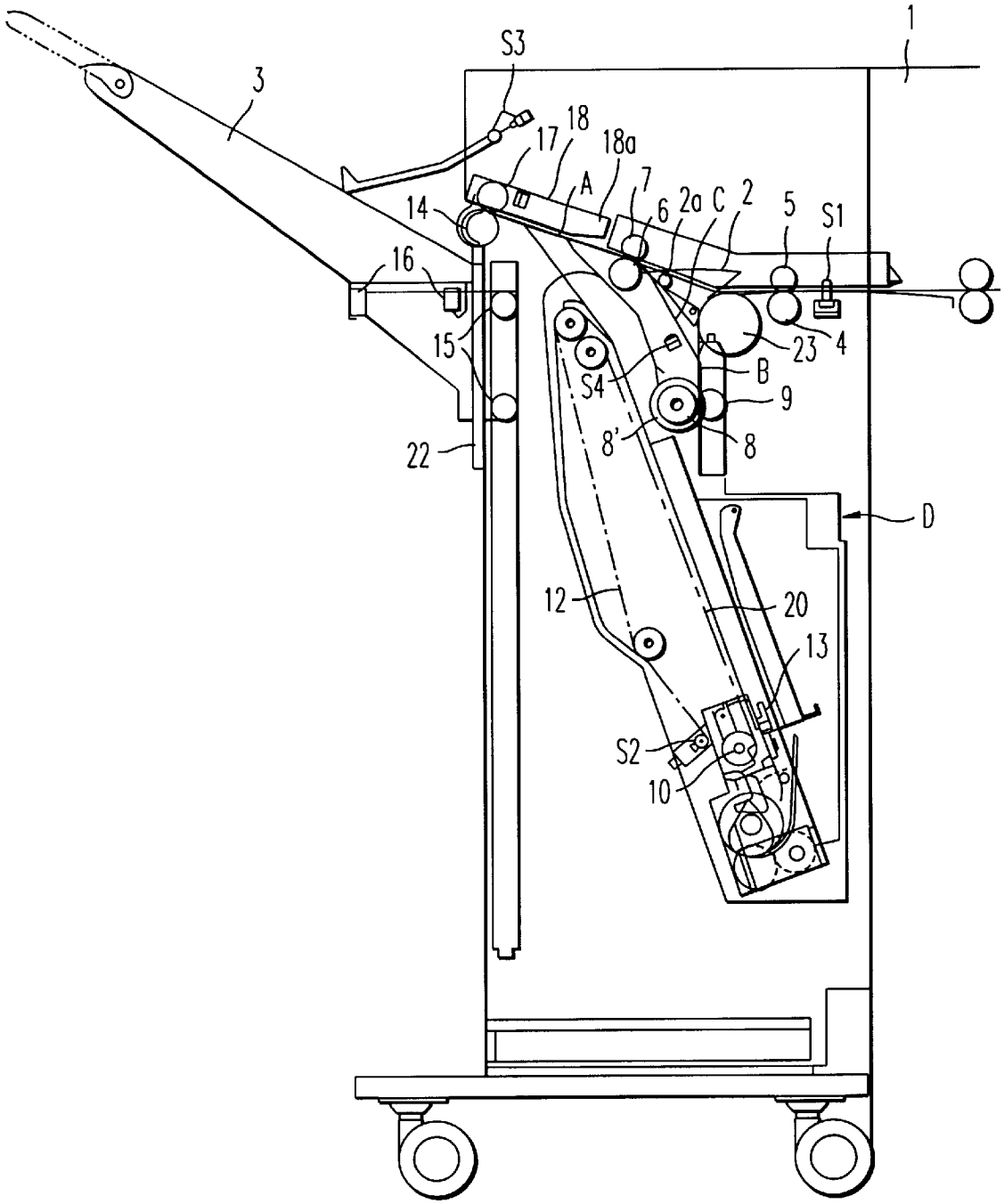
FIG. 1 shows an overall structure of an automatic document feeder according to the present invention.

The embodiments of the present invention will now be described with reference to the accompanying drawings, wherein like reference numerals designate identical or corresponding parts throughout the several views.

Referring to FIG. 1, a general configuration diagram of a document handler or burster trimmer stacker according to a first embodiment of the present invention is shown.

The document handler shown in FIG. 1 is installed in a paper output portion of an image forming apparatus, such as a printer, copier machine, facsimile machine, etc., and has a first paper delivery path A for a sort/stack processing which directly guides a paper output from the image forming apparatus 1 to a paper delivery tray 3 by a switching pawl 2. A second paper delivery path B is provided for a stapling operation or a paper inversion operation, and a third paper delivery path C is provided for guiding a paper advanced to the second paper delivery path B by an inversion of a paper delivery roller 8 which can be rotated both forwardly and reversely. The reference numeral 2*a* indicates a center of rotation of the switching pawl 2. The paper delivery tray 3 is arranged at a downstream side of the third paper delivery path C and has a function of stacking both of non-stapled paper forms and stapled paper forms.

A paper delivery roller 4 is positioned near an entry portion of the document handler. A follower roller 5 faces the delivery roller 4 and is provided for receiving a paper form output from the image forming apparatus 1. At a portion immediately before these rollers 4, 5, an entry sensor S1 is provided so as to sense a leading edge and/or a tailing edge of a paper form output from the image forming apparatus. Entry sensor S1 can be used to determine a paper size of the output paper form, or this information may be provided by the image forming apparatus 1.

The switching pawl 2 is provided downstream of the above-described paper delivery roller 4. By a switch operation of the switching pawl 2 (see FIG. 4) between a position indicated by a long and short dash line, see position 2' in FIG. 4, and a position indicated by a solid line, see position 2 in FIG. 4, by a solenoid, a spring, or the like (not shown), the paper form output from the image forming apparatus 1 can be delivered toward either the first paper delivery path A or the second paper delivery path B.

In the first paper delivery path A, a paper delivery roller 6 and a follower roller 7, which faces the paper delivery roller 6, are provided. The first paper delivery path A is used to guide a paper form to the paper output tray 3 after the paper form is output from the image forming apparatus 1, as guided by the switching pawl 2 switched to the position indicated by the long short dash line 2' in FIG. 4. This first delivery path A is completely used when no stapling or paper inversion operation is requested.

In addition, in the second paper delivery path B, a paper delivery roller 8 having a brush 8', described in further detail below, and a follower roller 9 are provided. The second paper delivery path B is used to guide a paper form to a staple unit D for stapling, or to the third paper delivery path C for a paper inversion, after the paper form is output from the image forming apparatus 1, as guided by the switching pawl 2 switched to the position indicated by the solid line 2 in FIG. 4.

The other units shown in FIG. 1 will be described with further reference to FIGS. 2–4.

Figure 2:
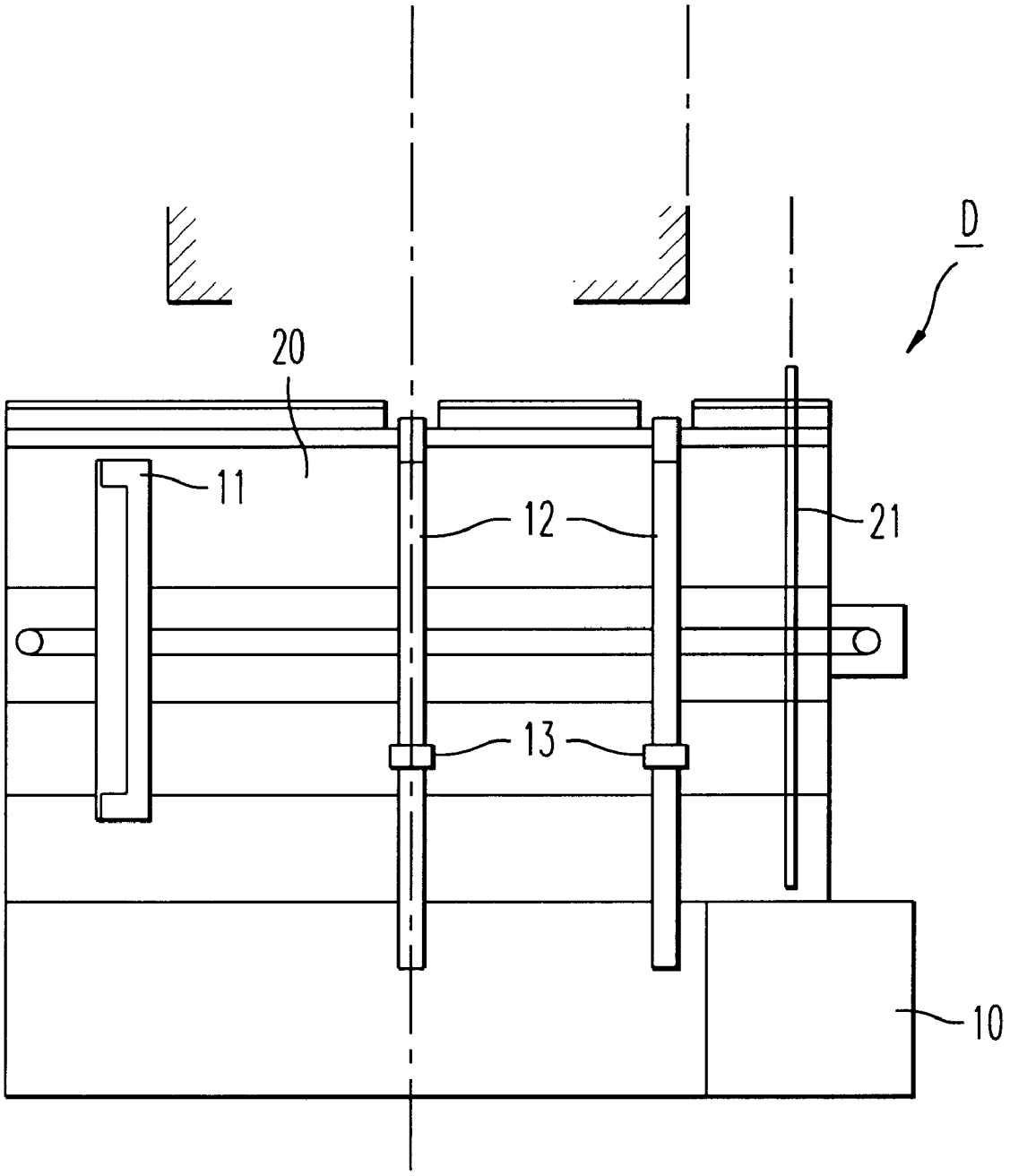
FIG. 2 shows a portion of the automatic document feeder of FIG. 1.
Figure 3:
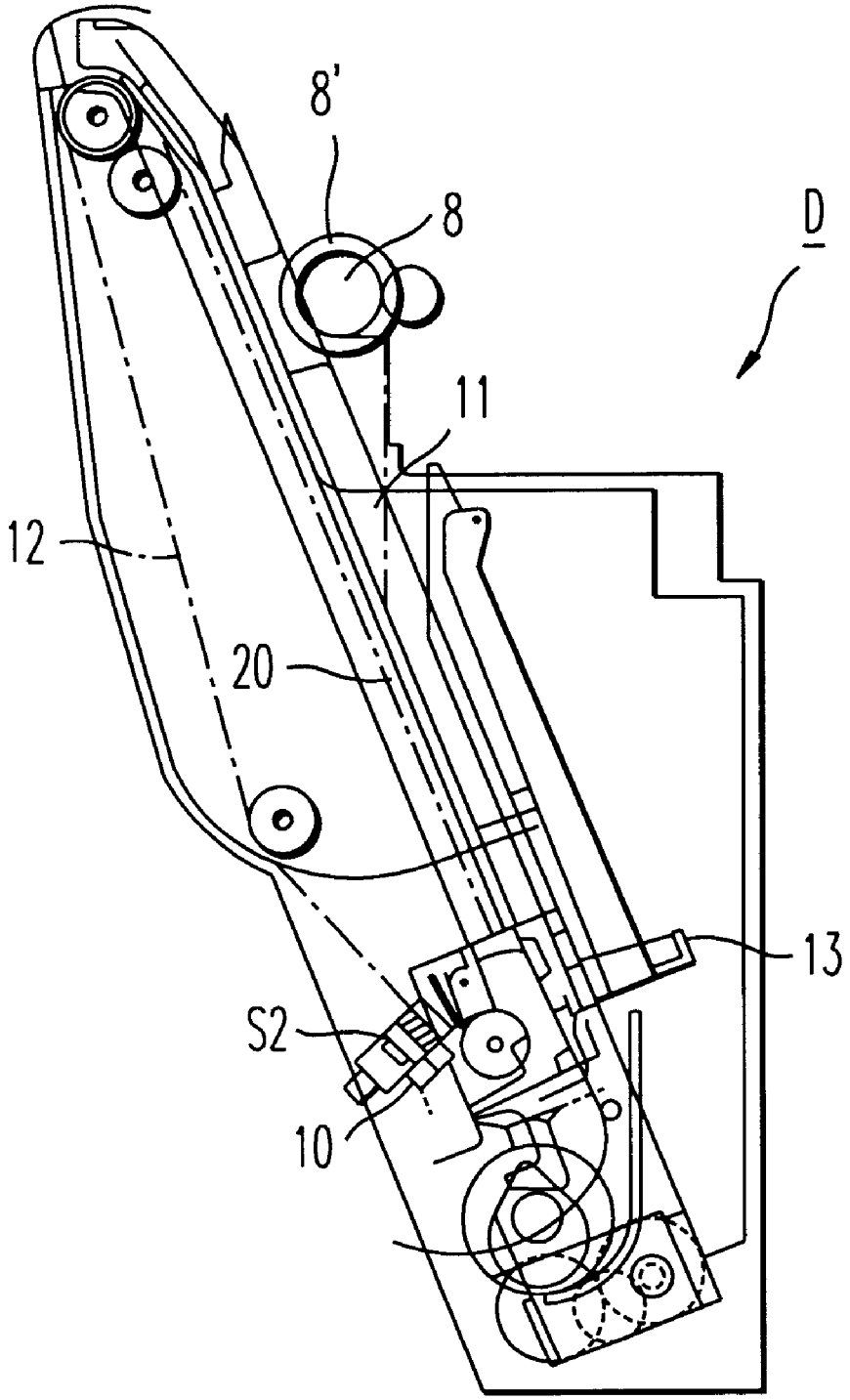
FIG. 3 shows a further portion of the automatic document feeder of FIG. 1.

FIG. 2 is a side view of the staple unit D (a side view when taking the view in FIG. 1 as a front view), and FIG. 3 is a front view of only the staple unit D.

The staple unit D includes a stapler 10 which is movable in a width direction of a paper form for stapling a paper form at predetermined positions, a jogger fence 11 which is movable orthogonally in a paper delivery direction for aligning paper forms in order in a width direction, a paper output belt 12 for outputting a stapled paper form to the paper output tray 3 by driving a paper stopper 13 (rear-end fence) fixed to the paper output belt, a staple tray 20, and a reference fence 21. A sensor S2 detects a position of the paper stopper 13. By detecting the position of the paper stopper 13 by the sensor S2, the paper stopper 13 is adjusted to a position matching the paper form size so that a position of a trailing edge of the paper form is always fixed according to the size of the paper form guided to the staple unit D.

As shown in FIG. 2, the reference fence 21 is arranged outside a range of a maximum width of the paper form during an inversion operation of the paper form so as to achieve a reference position of the paper form at stapling. The paper stopper 13 has both a function of a fence to which leading edges of the paper forms are positioned after the paper forms are guided to the staple tray 20 for positioning the paper forms in order, and a function of discharging stapled paper forms toward the paper deliver tray 3.

Figure 4:
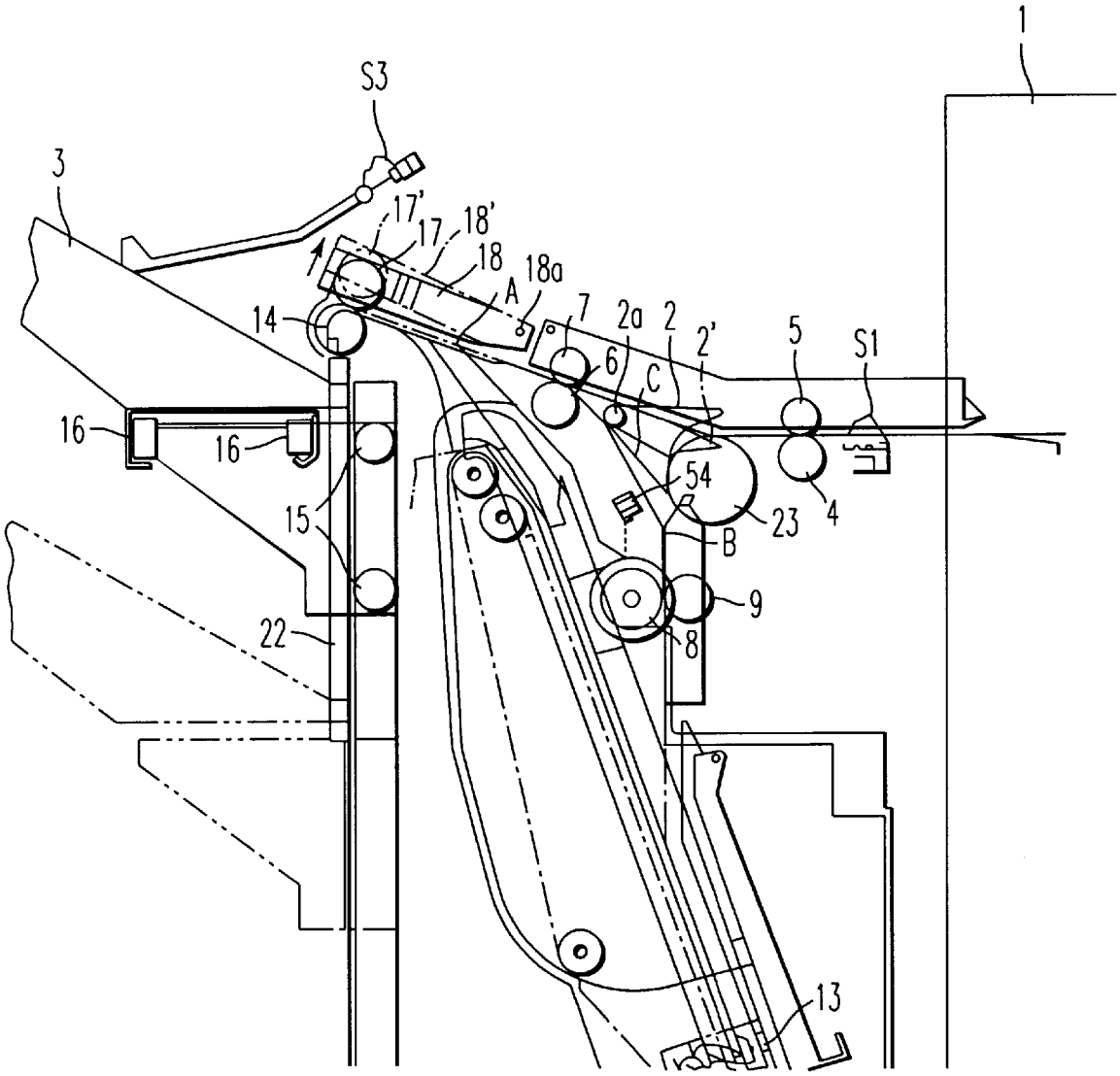
FIG. 4 shows specifics of a further portion of the automatic document feeder of FIG. 1.

FIG. 4 shows an enlarged configuration diagram of the paper output portion of the document handler.

In FIG. 4, at the paper output aperture to the paper output tray 3, a paper output roller 14 and a paper output follower roller 17, which faces the paper output roller 14, are provided to output non-stapled paper forms, stapled paper forms, and inverted paper forms to the paper output tray 3. The paper output follower roller 17, which is generally positioned in contact with the paper output roller 14, can be automatically moved in a direction indicated by the arrow together with a paper output guide plate 18 around a supporting point 18*a* according to a nerve and a thickness of a paper form to be output For example, the output guide plate 18 can move to a position indicated by the long and short dash lines at 17' and 18'.

The paper output tray 3 is vertically movable along a guide plate 22 by a vertical guide roller 15 which is driven by a driver (not shown). In addition, the paper output tray 3 is also movable orthogonally to the paper output direction (in a vertical direction in the Figures) by a shift guide roller 16, and the paper output tray 3 can be shifted by a driver (not shown) so as to assort the output paper forms. An upper surface detection sensor S3 detects an upper surface of output paper forms, so as to adjust a height of the paper output tray 3 so that an upper surface of a topmost paper form which has been most recently output and stacked is always at a predetermined position relative to the paper output roller 14.

In FIG. 1, reference numerals 23 and S4 indicate an inversion operation guide roller and an inversion operation entry sensor, respectively.

The document handler of the present invention is operable in three paper output modes of (1) a sort/stack mode in which a paper form is directly output to the paper output tray 3 without stapling or inversion, (2) a staple mode in which a paper form is stapled and then output, and (3) an inversion mode in which a paper form is inverted and then output. Each mode can be selected by, for example, a selection key in a control section (not shown) of the image forming apparatus 1.

The respective modes are now described below in further detail.

(1) Sort/Stack Mode

In the sort/stack mode the switching pawl 2 is put at a position indicated by a long and short dash line 2' in FIG. 4, and a paper form output from the image forming apparatus 1 is directly delivered to the first paper delivery path A, and is then delivered to a paper output aperture by the paper delivery roller 6. At this point, the paper output follower roller 17 is always in contact with the paper output roller 14 in a state of being pressed by gravity. With this positioning and operation a paper form is directly output to the paper output tray 3.

All output paper forms are then stacked on the paper output tray 3 sequentially. When the sensor S3 detects an upper surface of the stacked paper forms, a height of the paper output tray 3 is adjusted so that an upper surface of the topmost paper form on output tray 3 is always at a fixed height. In addition, if necessary, the paper output tray 3 can move orthogonally to the paper output direction in a shift operation to assort the output paper forms.

Also, in the staple and inversion modes described below, the paper output tray 3 can perform the same adjusting, moving and assorting operations in the same manner.

(2) Staple Mode

In the staple mode the switching pawl 2 is put at a position indicated by a solid line 2 shown in FIG. 4, and a paper form output from the image forming apparatus 1 is delivered to the second paper delivery path B, and is then delivered to the staple unit D. At this point, the paper stopper 13 is vertically moved over the paper delivery path of the staple tray 20 so that paper forms are stacked at fixed intervals with their trailing edges at a downstream side in the paper delivery direction from the paper delivery roller 8 based on a detection output of the sensor S2.

Furthermore, a brush roller 8' as a positioning element of the trailing edges of the paper forms is arranged coaxially with the paper delivery roller 8. The brush roller 8' may have a diameter larger than that of the paper delivery roller 8. With this brush roller 8', paper forms guided to the staple tray 20 are stacked with their leading edges positioned against the paper stopper 13 and their trailing edges pressed toward the staple tray 20.

Subsequently, the paper forms are adjusted toward the reference fence 21 by a reciprocating motion of the jogger fence 11 orthogonally to the paper delivery direction Accordingly, the paper forms are stacked in a state of being put against the reference fence 21 and the paper stopper 13. The jogger fence 11 repeats the same adjusting operation whenever respective paper forms advance to the staple tray 20, so that the paper forms arc stacked in order.

Next, the stacked paper forms are stapled by the movable stapler 10. After the stapling operation, the stapled stack of paper forms are delivered toward the paper delivery roller 14 by moving the paper stopper 13 upwardly, and then the stapled stack of paper forms is output to the paper output tray 3 by the paper output roller 14. After the paper output operation, the stapled stack of paper forms are positioned against the guide plate 22 by gravity so as to be stacked with their trailing edges even. For the stapled stack of paper forms, the height of the paper output tray 3 is adjusted so that a topmost surface of the stapled stack of paper forms is always at a fixed position in the same manner as for the sort/stack mode.

Figure 5C:
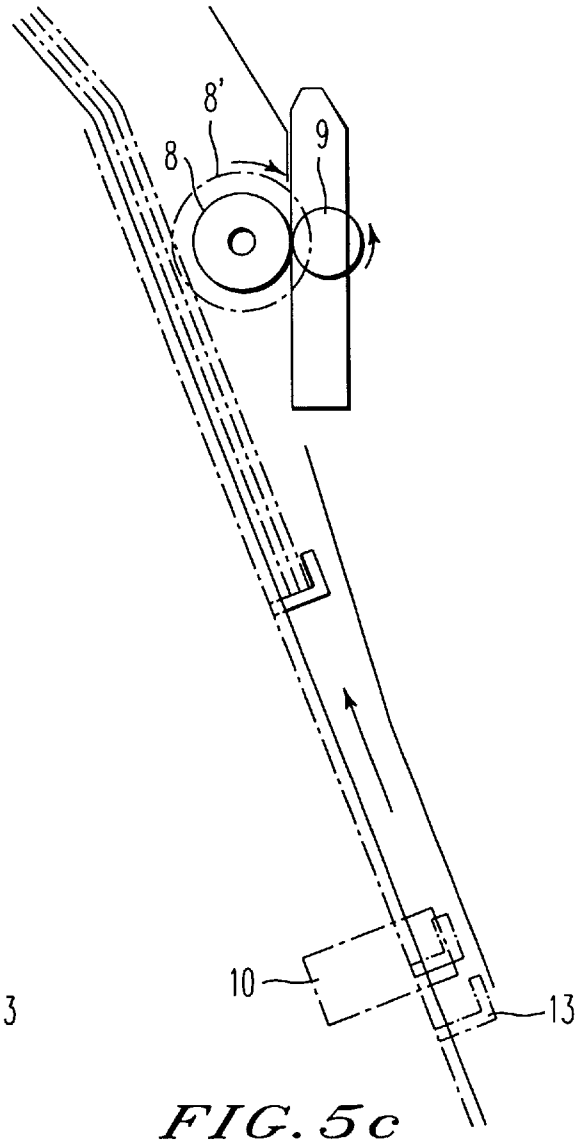
FIGS. 5(*a*)–5(*c*) show an operation of the automatic document feeder of FIG. 1.
Figure 5B:
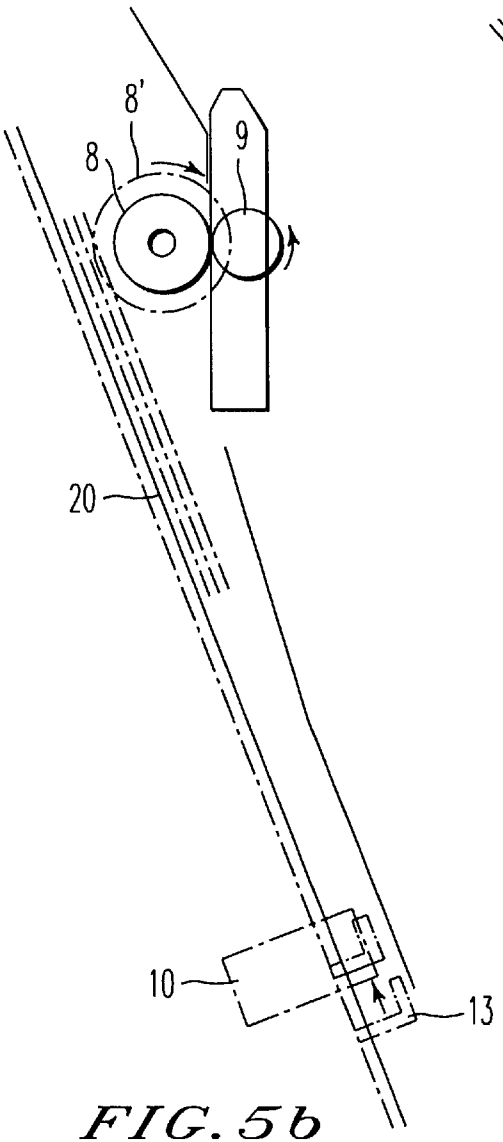
Figure 5A:
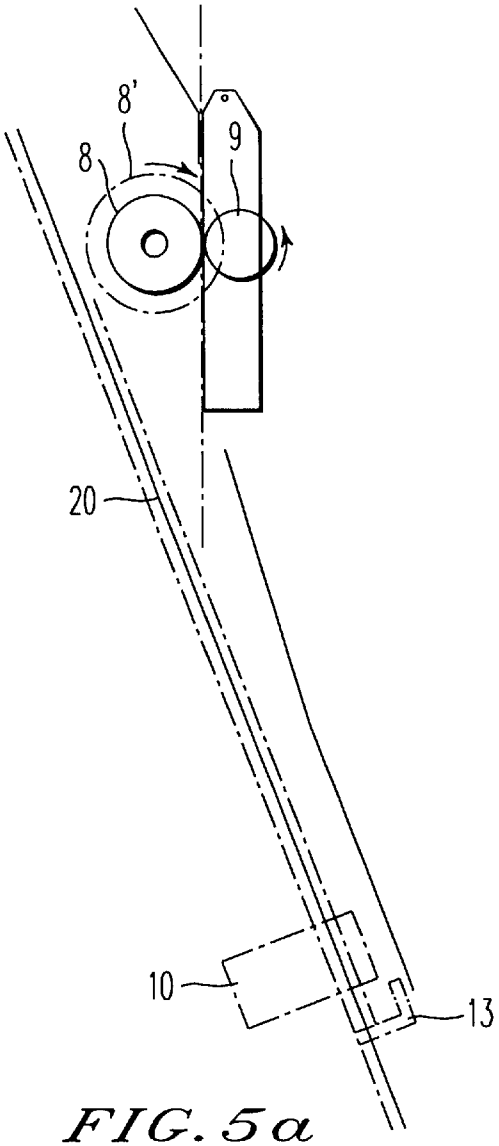

FIGS. 5(*a*)–5(*c*) further disclose an operation of the present invention in the staple mode.

First, as shown in FIG. 5(*a*), an input paper form is fed between the combination of delivery roller 8 and brush roller 8' and follower roller 9. This input paper form proceeds towards the paper stopper 13 and is positioned with a leading edge against the paper stopper 13. Further paper forms are then fed in the same manner and are stacked on the staple tray 20. The rotation of the brush roller 8' insures that the trailing edge of each of these paper forms is properly positioned against the staple tray 20. Then, the paper stopper 13 is moved so that the stacked paper forms are in a stapling position, see FIG. 5(*b*). Then, after the stapling operation is completed by stapler 10, the paper stopper 13 is moved upward, as indicated in FIG. 5(*c*), to output the stapled stack of paper forms.

Figure 6:
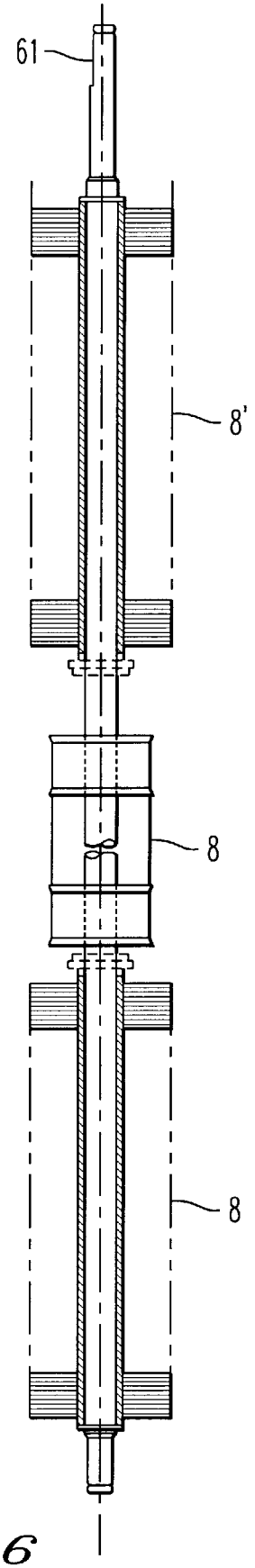
FIG. 6 shows a specific element of the automatic document feeder of FIG. 1.

A specific construction of the deliver roller 8 and brush roller 8' is shown in FIG. 6 of the present specification. In this embodiment, each of these rollers is formed on the same axle 61. In this structure, the delivery roller 8 can be formed at a central portion along the axle 61. Furthermore, brush roller portions 8' are formed on both sides of this deliver roller 8. The delivery roller 8 has a diameter which is greater than that of the axle 61, but which is less than that of the brush roller portions 8'. With this structure in the present invention, the delivery roller 8 contacts the paper forms passing thereby. However, since the brush roller portions 8' have a larger diameter than that of the delivery roller 8, the brush roller portions 8' can still contact the trailing edges of the paper forms after the trailing edges of the paper forms move past the delivery roller, i.e., without the delivery roller 8 contacting the paper forms, to thereby push the trailing edges of the paper form against the stapler tray 20. This structure and operation in the present invention ensure that the paper forms are properly positioned against the stacking tray 20.

(3) Inversion Mode

The inversion mode of the present invention refers to a mode in which paper forms fed to the document handler are inverted prior to being output to paper output tray 3. The inversion mode is selected so that documents can be stacked in proper order on the paper output tray 3. That is, if documents are input to the document handler of the present invention with an image on an upper surface of a paper form, to ensure that a multiple form document has the multiple forms stacked in a proper order, such forms are inverted prior to being output to paper output tray 3 The forms then output to paper output tray 3 have images on the bottom sides thereof and the paper forms are then in a proper order after the inversion mode.

In the inversion mode the switching pawl 2 is put in a position indicated by the solid line 2 in FIG. 4 in the same manner as for the staple mode, and a paper form output from the image forming apparatus 1 is guided to the second paper delivery path B. At this point, the beginning end of the switching pawl 2 is pressed against the inversion guide roller 23 and the paper form is delivered as it pushes away the beginning end of the switching pawl 2. In this operation the delivery roller 8 is rotating clockwise similarly as shown in FIGS. 5(*a*)–5(*c*).

Then, when the trailing edge of the paper form passes the switching pawl 2 and is detected by the inversion entry sensor S4, the paper delivery roller 8 stops rotating clockwise, and then starts to rotate in a reverse (counter-clockwise) direction. The paper form is then switched to a state of being inverted, i.e., turned upside down, and is then guided to the third paper delivery path C by the switching pawl 2. The inverted paper form is then delivered to the paper output aperture by the paper delivery roller 6 via the third paper delivery path C and the first paper delivery path A.

In this inversion mode, the paper stopper 13 fixed to the paper output belt 12 is diverted to a position where it does not contact the leading edge of the paper form guided to the second paper delivery path B. The position of the paper stopper 13 is set by the sensor S2 for detecting the position of the paper stopper 13.

Next, a more detailed description is made below of operations of the present invention with reference to FIGS. 5(*a*)–5(*c*).

If a staple mode is selected, a paper output from the image forming apparatus 1 is guided to the staple unit D via the second paper delivery path B by the switching pawl 2. In this operation, the paper stopper 13 is moved along the paper delivery path of the staple tray 20 according to the paper form size (e.g. as sensed by sensor S1 or as output from image forming apparatus 1) and is then stopped at a position where the trailing edge of the paper form is apart from a nip portion between the paper delivery roller 8 and the follower roller 9, see FIG. 5(*a*). The paper stopper 13 is positioned so that the brush roller 8' contacts the trailing edges of the paper forms while the leading edges are against the paper stopper 13. Accordingly, the paper forms are contacted at their rear end by the rotating brush roller 8' and are then stacked while being pushed toward the staple tray 20. This ensures proper stacking of the paper forms on the staple tray 20.

Additionally in the stapling mode, the paper stopper 13 is moved along the paper delivery path of the staple tray 20 so as to be adjusted to a stapling position of the stapler 10, see FIG. 5(*b*). The paper form moved to the stapling position is then stapled at at least one predetermined position by the stapler 10 (at a single place or at a plurality of places). After the stapling operation, the stapled paper form is delivered toward the paper stopper 13 by moving the paper stopper 13 upwardly along the paper delivery path of the staple tray 20, see FIG. 5(*c*). Then the stapled paper form is output to the paper output tray 3 by the paper output roller 14.

Figure 7:
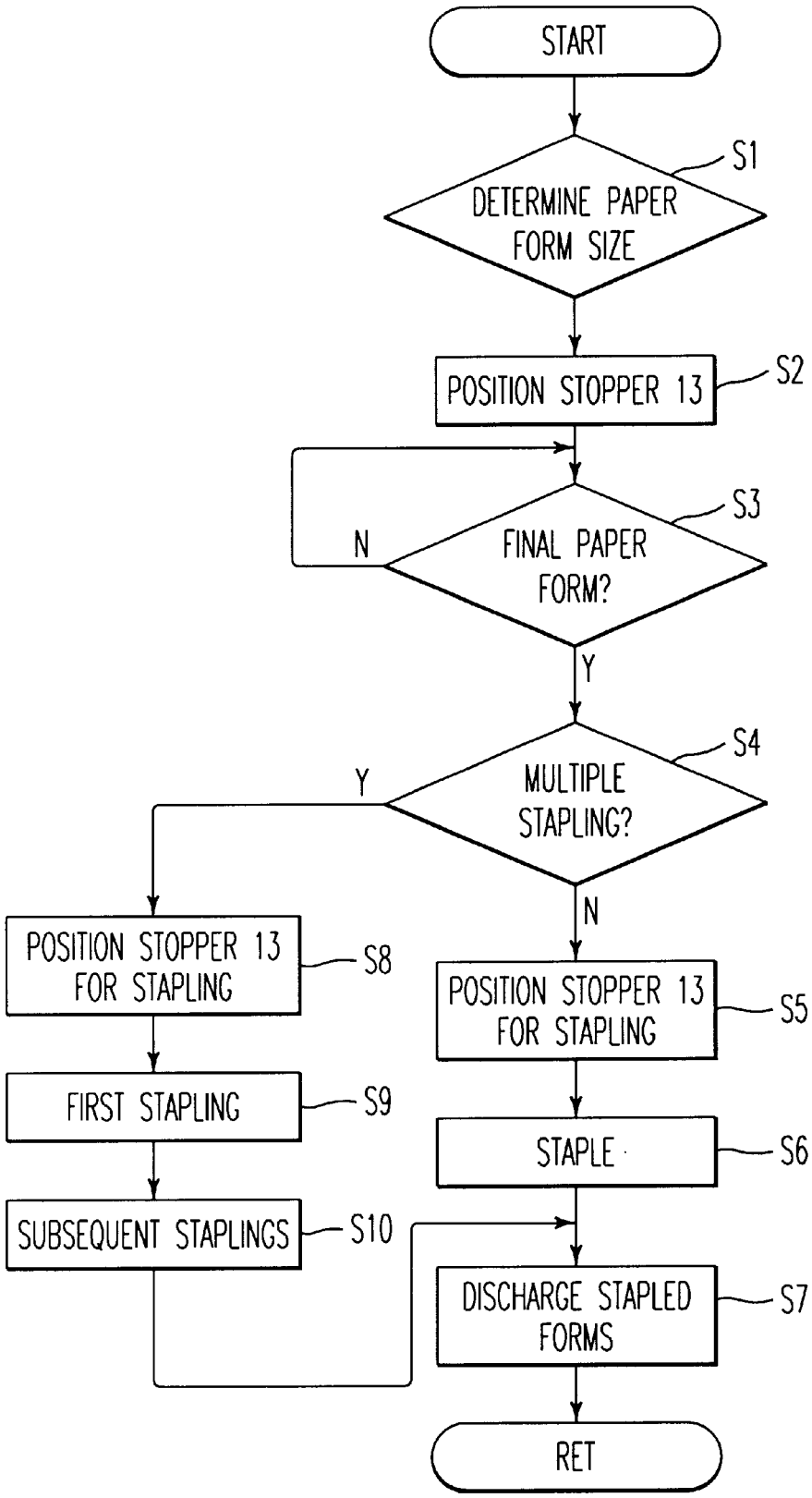
FIG. 7 shows a flow chart of an operation of the automatic document feeder of FIG. 1.

FIG. 7 is a flowchart illustrating an example of a control of the stapling operation of the present invention.

In the staple mode, in a step S1 a size of the paper form is determined, for example by sensor S1 or an input from image forming apparatus 1. Then, in a step S2 the paper stopper 13 is positioned so that a trailing edge of the paper form is at a proper fixed position according to a size of the paper form determined in step S1. Then, it is determined in step S3 whether or not a final paper form of a set of paper forms to be stapled has been stacked on the staple tray 20. If the stacking is completed (YES in step S3), the operation proceeds to step S4. Otherwise, (NO in step S3), step S3 is repeated.

After the final paper form has been stacked on staple tray 20 (YES in step S3), it is then determined in step S4 whether a single-place stapling operation or a plurality of places stapling operation has been selected in a staple mode selection. If the plurality of places stapling operation has selected (YES in step S4), the operation proceeds to step S8. If the single-place stapling operation has been selected (NO in step S4), the operation proceeds to step S5.

If the single-place stapling operation has been selected (NO in step S4), the operation is as follows. In step S5 the paper stopper 13 is moved along the paper delivery path of the staple tray 20 from a paper form acceptance position to a stapling position of the stapler 10 according to the paper form size, see FIG. 5(*b*). Then, in step S6 the paper forms are stapled at a predetermined position by the stapler 10. Subsequently, in step S7 the stapled stacks of paper forms for which the stapling operation has been completed are discharged toward the paper output roller 14 by moving the paper stopper 13 upwardly along the paper delivery path of the staple tray 20, see FIG. 5(*c*). Then the stapled stack of paper forms are output to the paper output tray 3 by the paper output roller 14.

If the plurality of places stapling operation has been selected (YES in step S4), the operation is as follows. In step S8, the paper stopper 13 is moved from the paper form acceptance position to the stapling position of the stapler 10, see FIG. 5(*b*). Then, in step S9 the stacked paper forms are stapled at a predetermined position by the stapler 10 as a first stapling operation. Next, in step S10 the stapler 10 is moved to a second and any subsequent position for a second and any subsequent stapling operation, and then the stacked paper forms are stapled at the second and any subsequent position by the stapler 10. In this way, this subsequent stapling operation is repeated by a fixed number of times according to the selected number of the stapling positions. Then, the operation proceeds to step S7 in which the stapled stack of paper forms for which the stapling operation has been completed are delivered toward the paper delivery roller 14 by moving the paper stopper 13 upwardly along the paper delivery path of the staple tray 20, see FIG. 5(*c*). Then the stapled stack of paper forms are output to the paper output tray 3 by the paper output roller 14.

The embodiment of the present invention as described above includes the use of a brush roller 8' to properly position trailing edges of paper forms against staple tray 20. However, a different element as a positioning element of the trailing edges of the paper forms can be provided as shown in FIG. 8.

Figure 8:
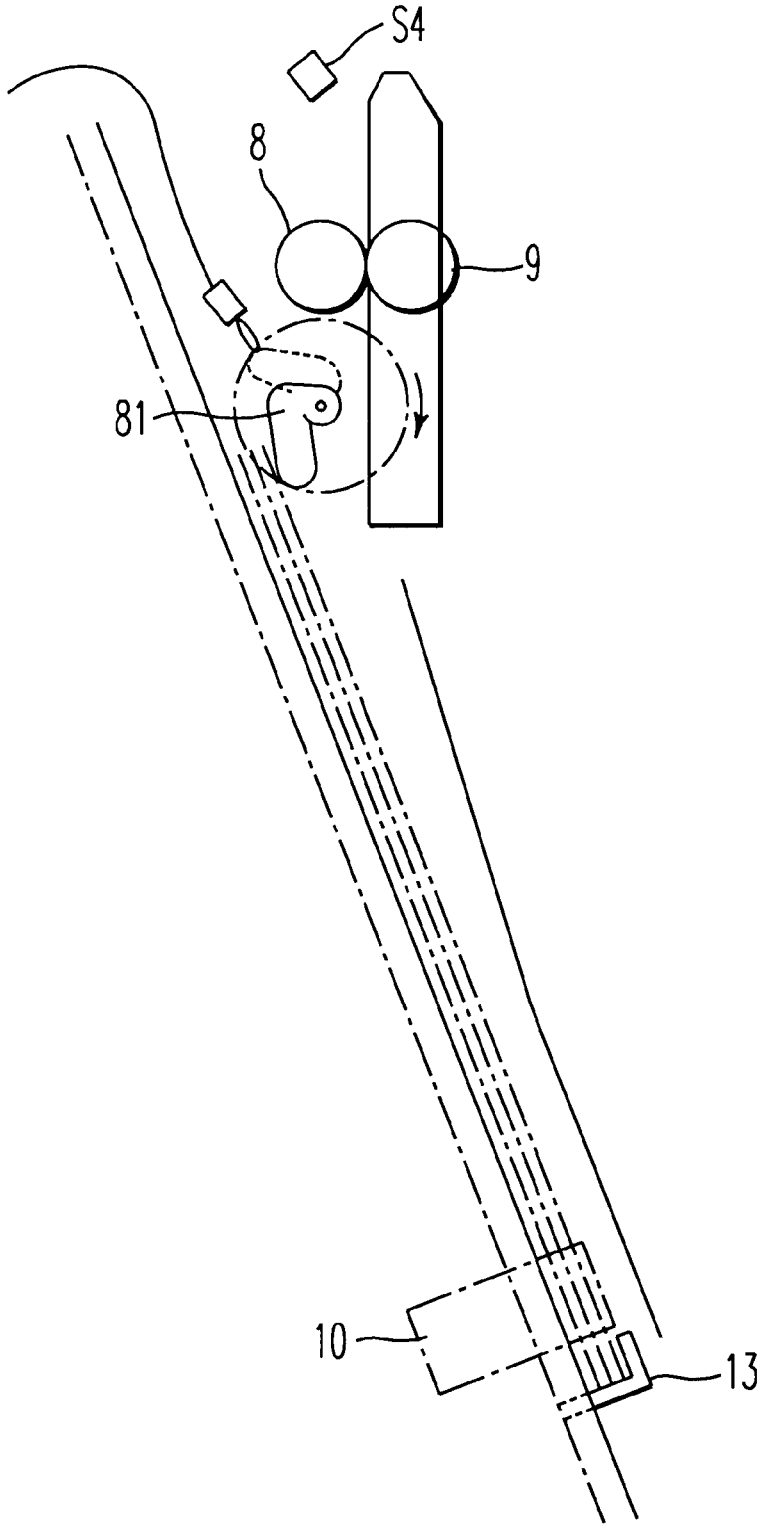
FIG. 8 shows a further embodiment of a feature of the present invention.

As shown in FIG. 8 in lieu of the brush roller 8', a pushing lever 81 can be provided at a staple tray 20. In this embodiment of the present invention, the entrance sensor S4 is still disposed upstream of the staple tray 20. In this embodiment as shown in FIG. 8, a trailing edge of the paper form is detected by the sensor S4, and then the pushing lever 81 is rotated by a stepping motor (not shown) so that the trailing edge of the paper form is pushed toward the staple tray 20. The rotation of the pushing lever 81 is controlled to rotate a predetermined rotational angle from a home position as shown from the dotted lines in FIG. 8 by counting a predetermined number of stepping pulses. The paper stopper 13 is again disposed at the staple tray 20 and is again movably positioned corresponding to a size of the copy sheet, so that the pushing lever 81 always contacts the trailing edge of a paper form of any size. Pushing lever 81 is further stopped in rotation in a state of pushing the paper form towards the stapling tray 20. The pushing lever 81 can then start rotating again after a predetermined time has passed when the trailing edge of a next paper form is detected by the sensor S4. This action is repeated until a last paper form to be stapled is positioned on the staple tray 20.

Figure 9:
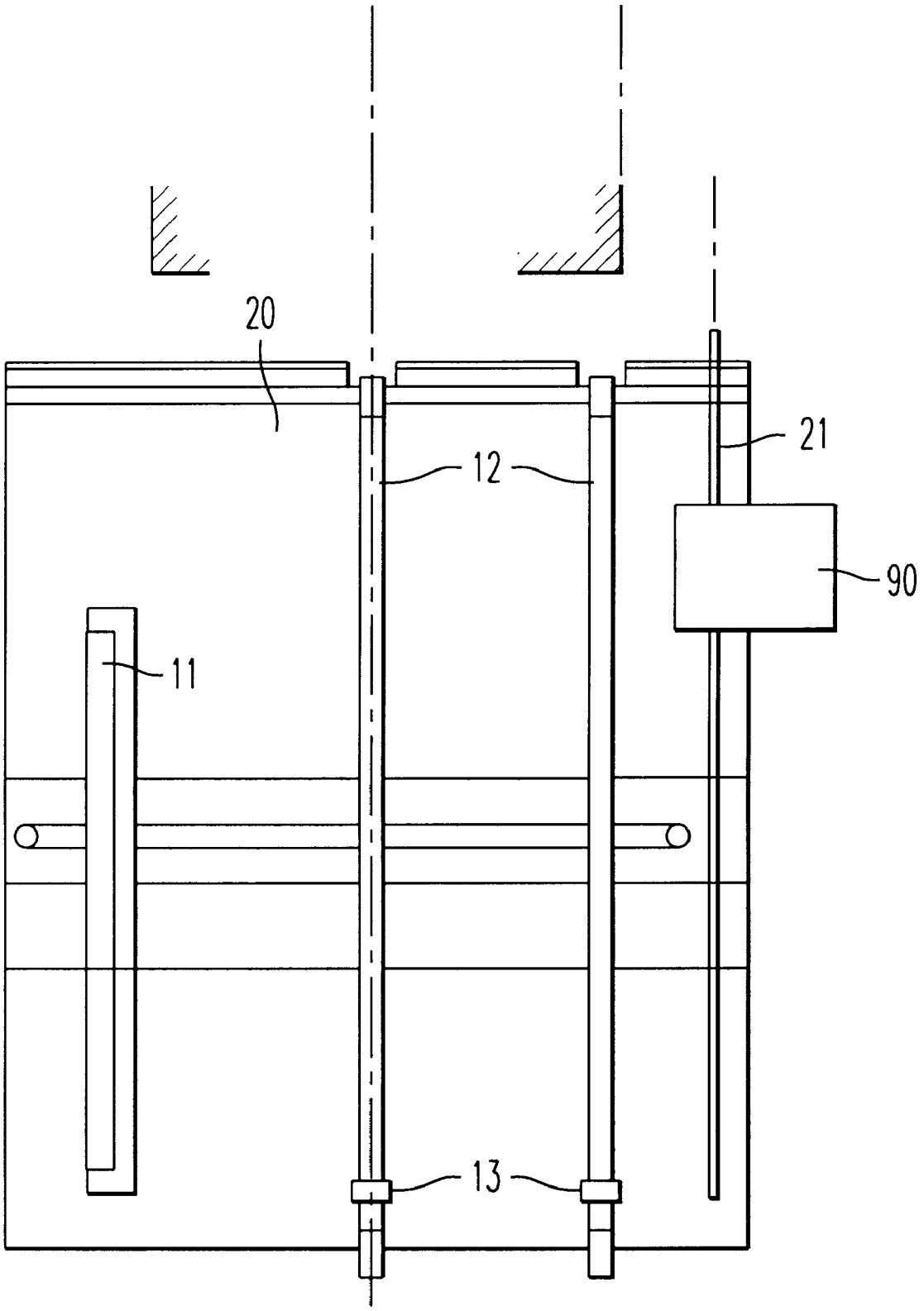
FIG. 9 shows a further embodiment of a feature of the present invention.
Figure 10:
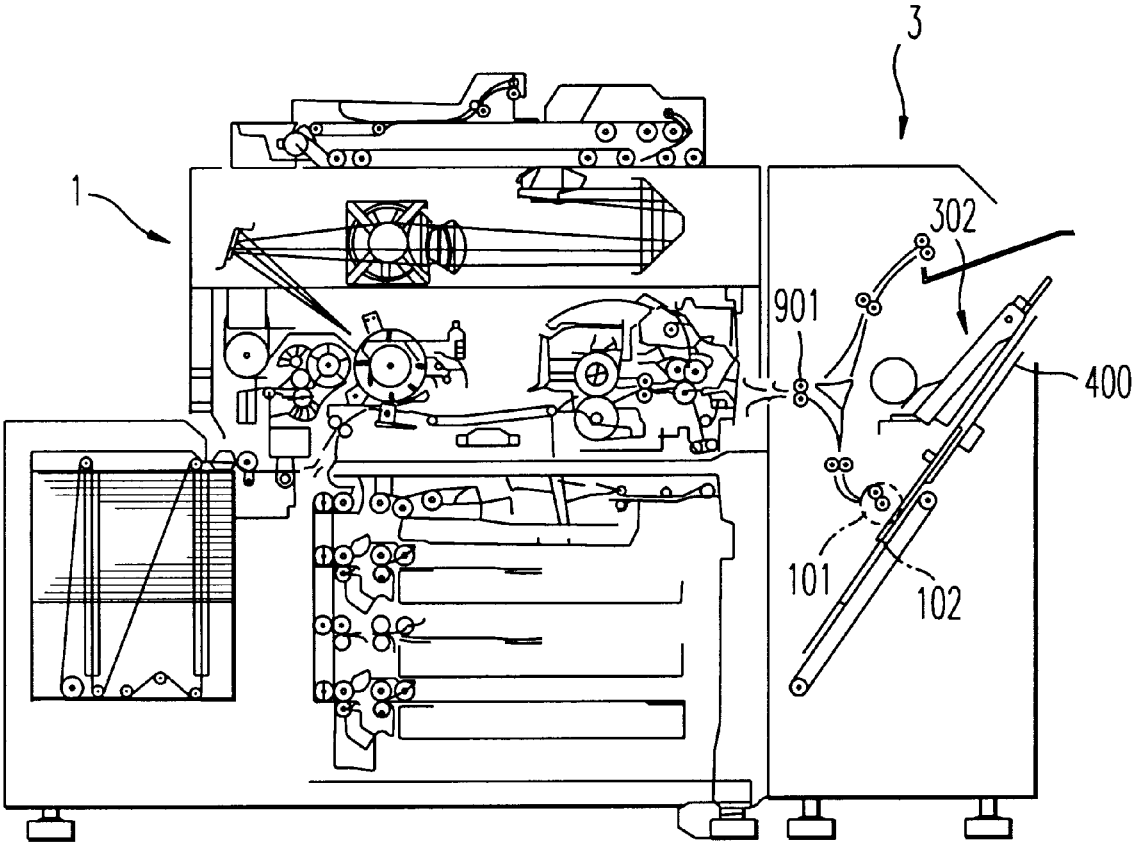
FIG. 10 BACKGROUND ART
FIG. 10 shows a background automatic document feeder.

In the embodiment described above, the stapler 10 is movable along a paper feed direction. As a further embodiment of the present invention as shown in FIG. 9, a stapler 90 can be disposed on a side of the staple tray 20 and can be stationary. With this structure, when a stapling of a stack of paper forms at a plurality of positions is executed, the stack of paper forms is first stapled by the stapler 90 at a first position. Then, the stack of paper forms is moved by repositioning paper stopper 13 either upward or downward to change the position of the stack of paper forms relative to the stapler unit 10. Then, a second stapling operation by the stapler 10 can be executed on the stack of paper forms at a second height. This operation can of course be repeated for further stapling operations.

With this embodiment of the present invention as shown in FIG. 9, if a first stapling position on the stack of paper forms is lower than a second stapling position, the ejecting of the stapled stack of paper forms can be quickened because the interval between the ejection tray and the second stapling position, namely the last stapling position, becomes shorter. Moreover, if the stapler 90 is disposed at a position where stapling for a shorter size paper form is executed, the paper stopper 13 can most efficiently be changed in position, corresponding to different sizes of the paper forms.

According to the above-discussed embodiments of the present invention, the paper stopper 13 has a function as a trailing-edge fence for adjusting a position of the trailing edges of paper forms, so that it is possible to perform a stack operation, a paper form shift operation at stapling, and a paper form output operation at a completion of the stapling, and therefore a document handler with a simple configuration and with a space saving can be achieved, as well as lowering cost.

Furthermore, according to the embodiments of the present invention, the paper stopper 13 is vertically movable along the paper delivery path of the staple tray 20, and therefore a fine adjustment such as, for example, an adjustment of stapling positions, can be performed by appropriate software (e.g. a computer program contained in the document handler).

Obviously, numerous additional modifications and variations of the present invention are possible in light of the above teachings. It is therefore to be understood that within the scope of the appended claims, the present invention may be practiced otherwise than as specifically described herein.

The present application is based on Japanese priority document 8-113709, the contents of which are incorporated herein by reference.

What is claimed as new and is desired to be secured by Letters Patent of the United States is:

1. A document handler operable in a staple mode, comprising:

a tray on which at least one document, having a leading edge and a trailing edge, to be stapled is stacked such that the trailing edge is positioned above the leading edge on the tray;

a rotatable positioning element and a driving roller for directing the at least one document to the tray in a staple mode, said positioning element aligning a trailing edge as an upper portion of the at least one document without a stopper member;

at least one movable stopper positioned at the tray for stopping the leading edge of the at least one document, wherein the at least one movable stopper is moveable to be positioned based on a size of the at least one document such that the trailing edge of the at least one document contacts the positioning element when the leading edge of the at least one document contacts the at least one movable stopper and is being stacked on the tray.

2. The document handler according to claim 1, further comprising a stapler stapling the at least one document stacked on the tray in at least one place.

3. The document handler according to claim 2, wherein the stapler is movable and staples the at least one document stacked on the tray at multiple places.

4. The document handler according to claim 2, wherein after completion of stacking the at least one document on the tray, the at least one movable stopper is further moved such that the at least one document stacked on the tray is positioned and stapled at a staple position by said stapler.

5. The document handler according to claim 3, wherein after completion of stacking the at least one document on the tray, the at least one movable stopper is further moved such that the at least one document stacked on the tray is positioned and stapled at a staple position by said stapler.

6. The document handler according to claim 4, wherein after stapling of the at least one document, the at least one movable stopper is further moved to discharge the stapled at least one document.

7. The document handler according to claim 5, wherein after stapling of the at least one document, the at least one movable stopper is further moved to discharge the stapled at least one document.

8. The document handler according to claim 2, wherein the stapler is stationary and staples the at least one document in one of a single place staple mode, in which the at least one document is stapled at only one place, and a multiple-place staple mode, in which the at least one document is stapled at multiple places, and wherein the at least one movable stopper is moved to reposition the at least one document at the multiple places during the multiple-place staple mode.

9. The document handler according to claim 1, wherein the positioning element comprises a fur brush.

10. The document handler according to claim 1, wherein the positioning element comprises a positioning lever.

11. A document handler operable in a staple mode, comprising:

a stacking means on which at least one document, having a leading edge and a trailing edge, to be stapled is stacked such that the trailing edge is positioned above the leading edge on the stacking means;

a rotatable positioning means and a driving means for directing the at least one document to the stacking means in a staple mode, said positioning means aligning a trailing edge as an upper portion of the at least one document without a stopper member;

at least one movable stopper means positioned at the stacking means for stopping the leading edge of the at least one document, wherein the at least one movable stopper means is moveable to be positioned based on a size of the at least one document such that the trailing edge of the at least one document contacts the at least one movable positioning means when the leading edge of the at least one document contacts the stopper means and is being stacked on the stacking means.

12. The document handler according to claim 11, further comprising a stapler means for stapling the at least one document stacked on the stacking means in at least one place.

13. The document handler according to claim 12, wherein the stapler means is movable and staples the at least one document stacked on the stacking means at multiple places.

14. The document handler according to claim 12, wherein after completion of stacking the at least one document on the stacking means the at least one movable stopper means is further moved such that the at least one document stacked on the stacking means is positioned and stapled at a staple position by said stapler means.

15. The document handler according to claim 13, wherein after completion of stacking the at least one document on the stacking means the at least one movable stopper means is further moved such that the at least one document stacked on the stacking means is positioned and stapled at a staple position by said stapler means.

16. The document handler according to claim 12, wherein after stapling of the at least one document, the at least one movable stopper means is further moved to discharge the stapled at least one document.

17. The document handler according to claim 15, wherein after stapling of the at least one document, the at least one movable stopper means is further moved to discharge the stapled at least one document.

18. The document handler according to claim 12, wherein the stapler means is stationary and staples the at least one document in one of a single place staple mode, in which the at least one document is stapled at only one place, and a multiple-place staple mode, in which the at least one document is stapled at multiple places, and wherein the at least one movable stopper means is moved to reposition the at least one document at the multiple places during the multiple-place staple mode.

19. The document handler according to claim 11, wherein the positioning means comprises a fur brush means.

20. The document handler according to claim 11, wherein the positioning means comprises a positioning lever means.

* * * * *